US006949019B2

(12) United States Patent
Wentworth et al.

(10) Patent No.: US 6,949,019 B2
(45) Date of Patent: Sep. 27, 2005

(54) FLAP-TYPE ROTARY FINISHING DEVICE

(75) Inventors: Robert J. Wentworth, Farmington Hills, MI (US); Douglas J. Calvin, Livonia, MI (US)

(73) Assignee: Belanger Industrial Products, Inc., Northville, MI (US)

( * ) Notice: Subject to any disclaimer, the term of this patent is extended or adjusted under 35 U.S.C. 154(b) by 0 days.

(21) Appl. No.: 10/707,780

(22) Filed: Jan. 12, 2004

(65) Prior Publication Data

US 2005/0153639 A1 Jul. 14, 2005

(51) Int. Cl.[7] ..... B24B 9/02
(52) U.S. Cl. ..... 451/466; 451/469
(58) Field of Search ..... 451/466, 467, 451/464, 468, 469, 463, 541; 15/230

(56) References Cited

U.S. PATENT DOCUMENTS

| | | | | |
|---|---|---|---|---|
| 3,212,210 | A | 10/1965 | Schmelzer, Jr. | |
| 3,872,630 | A | 3/1975 | Ali | |
| 3,890,746 | A * | 6/1975 | Saegusa et al. | 451/469 |
| 4,004,316 | A | 1/1977 | Ali | |
| 4,080,714 | A * | 3/1978 | Emerson | 29/509 |
| 4,183,183 | A * | 1/1980 | Belanger | 451/469 |
| 4,217,737 | A * | 8/1980 | Hasegawa | 451/469 |
| 4,258,509 | A * | 3/1981 | Wray et al. | 451/466 |
| 4,365,448 | A | 12/1982 | Wilson | |
| 4,872,292 | A * | 10/1989 | Block | 451/466 |
| 5,233,719 | A | 8/1993 | Young et al. | |
| 5,295,332 | A | 3/1994 | Tyler et al. | |
| 5,423,718 | A | 6/1995 | Tyler et al. | |
| 5,554,068 | A | 9/1996 | Carr et al. | |
| 6,217,431 | B1 * | 4/2001 | Brinkmann | 451/466 |
| 6,592,442 | B2 * | 7/2003 | Hoffheimer | 451/466 |
| 6,595,843 | B1 | 7/2003 | Weber | |
| 2003/0092370 | A1 * | 5/2003 | Lundum | 451/466 |

* cited by examiner

*Primary Examiner*—Dung Van Nguyen
(74) *Attorney, Agent, or Firm*—John S. Artz; Artz & Artz, PC

(57) ABSTRACT

A rotary finishing device including a generally circular hub having an inner periphery and an outer periphery. The outer periphery includes a plurality of slots formed thereabout, which are defined by a pair of side portions. The plurality of slots are generally uniformly spaced about the outer periphery of the hub. Each of the slots has at least one finishing sheet secured therein by an adhesive.

13 Claims, 10 Drawing Sheets

FLAP-TYPE ROTARY FINISHING DEVICE

BACKGROUND OF INVENTION

The present invention relates generally to a rotary finishing device, and more particularly to a flap-type rotary finishing device having an epoxy attachment of the finishing media to a hub of the flap wheel.

Rotary finishing tools are well known and typically include pieces or strips of a finishing medium. Such tools have proven to be very effective in the finishing of a wide variety of components such as those made from metal or the like. An exemplary rotary finishing tool utilizes generally rectangular pieces of abrasive paper, such as sandpaper, to provide a rotary abrasive device.

One of the more common rotary finishing tools or devices is known in the art as a flap wheel. These flap wheels typically have annular arrays of flexible finishing strips and are commonly used in the finishing art. Most conventional rotary finishing devices consist of flexible strips each comprising sheets of material for finishing a surface of a piece. Many of these rotary finishing devices have abrasive particles bonded on one face thereof. Such rotary abrasive devices are useful for contoured polishing, cutting, or surface abrading of a variety of metal surfaces.

Various fabrication methods for such a rotary device are known. One such conventional method requires that the finishing sheets have two notches in their opposite side edges near the base end of each strip. As the strips are arranged in an annular array, the notches form concentric circular depressions on opposite sides of the annular array. Suitable circular reinforcement mechanisms, such as two metallic end caps are mounted on opposite sides of the array. Each end cap has an inwardly extending lip, which engages the circular depressions to mechanically grip the inner ends of the finishing strips. This method thus relies on friction created between the two metallic end caps to maintain the base ends of the strips in contact with a hub of the rotary device. Although a rotary finishing device of this configuration performs suitably, its manufacture is rather expensive and requires two notches to be formed in each strip prior to assembly. The forming of these notches is both time consuming and costly. Further, the notches must be aligned properly with respect to each other to receive accurate placement of the metal end caps.

Another known fabrication method for a rotary finishing device involves attaching the strips to an aluminum clip, such as by stapling. The metal clip with the attached strips is then loaded into a metal hub. A plurality of pins are then used to secure the hub to an end cap. These pins maintain the strips in communication with the metal hub, such that it is relatively difficult for the strips to become disengaged from the hub during polishing. However, these rotary devices are also relatively expensive and also require a relatively cumbersome assembly process.

Yet another known fabrication process involves attaching the finishing media through the use of a suitable adhesive. This adhesive, such as an epoxy, is applied to the strips at their base ends to bond them to one another to form a unitary structure. The adhesive itself thus becomes the hub. Alternatively, a cardboard center is utilized to control the flow of adhesive. The cardboard center merely While these rotary devices are relatively inexpensive to produce, they are prone to breakage issues after high use. This breakage typically occurs due to failure of the epoxy, which is the weakest part of the device, as a result of the application of significant force during usage. When this breakage or failure of the rotary device occurs, a portion of the epoxy, together with the adhered strips, typically separates from the device. This results in an imbalanced rotary device, which requires replacement. Additionally, when the breakage occurs, because of the relatively high operating speeds of these devices, the separated portion can become a projectile, which can raise safety concerns or cause damage to the finishing device or surrounding apparatus.

Therefore, a need exists for a rotary finishing device that is relatively inexpensive to manufacture, but has sufficient strength to withstand the high operating speeds to which these devices are subjected.

SUMMARY OF INVENTION

One advantage of the present invention is to provide a rotary finishing device that is less expensive than prior rotary finishing devices.

Another advantage of the present invention is to provide a rotary finishing device that decreases the assembly time of the device without compromising its strength or integrity.

Yet another advantage of the present invention is to provide a rotary finishing device that can be more inexpensively manufactured for a wide variety of different applications.

A further advantage of the present invention is to provide a rotary finishing device that can be manufactured in a variety of different widths and lengths.

In accordance with the above and the other advantages of the present invention, a rotary finishing device is provided. The rotary finishing device includes a generally circular hub having an inner periphery and an outer periphery. The inner periphery defines a passageway therethrough. The outer periphery of the hub has a plurality of slots extending therefrom. Each of the plurality of slots is defined by a pair of side portions. Additionally, the plurality of slots are generally uniformly spaced around the outer periphery. Each of the plurality of slots includes at least one finishing sheet secured therein. The at least one finishing sheet is secured within each of the plurality of slots by an adhesive.

Other advantages of the present invention will become apparent when viewed in light of the detailed description of the preferred embodiment when taken in conjunction with the attached drawings and appended claims.

BRIEF DESCRIPTION OF DRAWINGS

For a more complete understanding of this invention, reference should now be made to the embodiments illustrated in greater detail in the accompanying drawings and described below by way of examples of the invention.

DETAILED DESCRIPTION

Referring now to the Figures, which illustrate various embodiments of a rotary finishing device in accordance with the present invention. The rotary finishing devices can be utilized to finish a surface, such as by polishing, abrading or the like. However, it will be understood that the finishing devices disclosed herein can be utilized for a variety of different purposes and can be formed with a variety of different configurations. Moreover, the finishing media utilized with the disclosed finishing devices can also vary depending upon the application for which the finishing devices will be used and can include cloth, sandpaper or the like. It will also be understood that a variety of different finishing media may be utilized.

Figure 1:
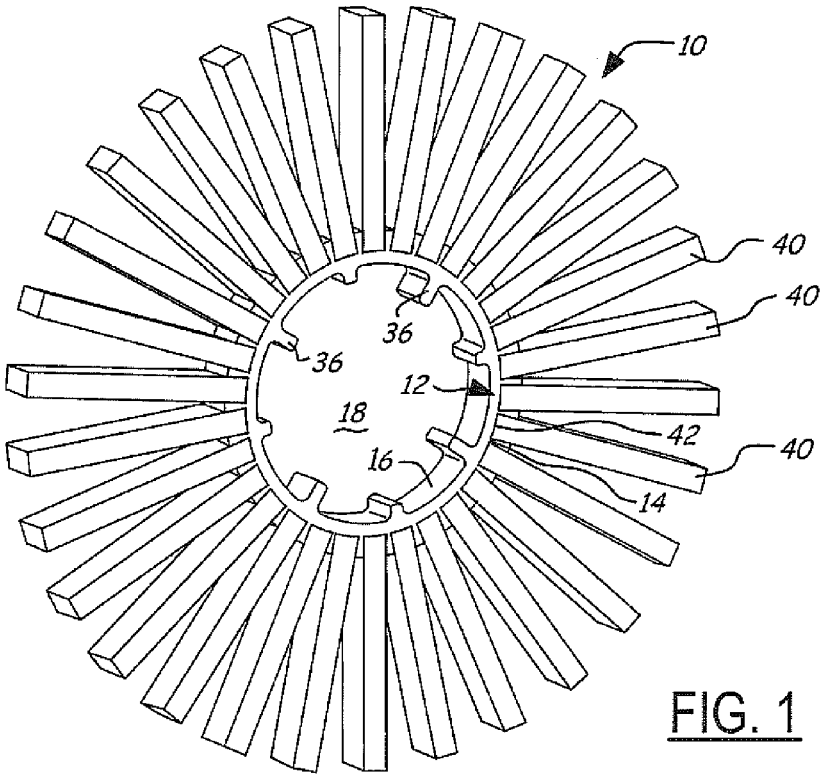
FIG. 1 is a perspective view of a flap wheel, in accordance with one embodiment of the present invention.
Figure 2:
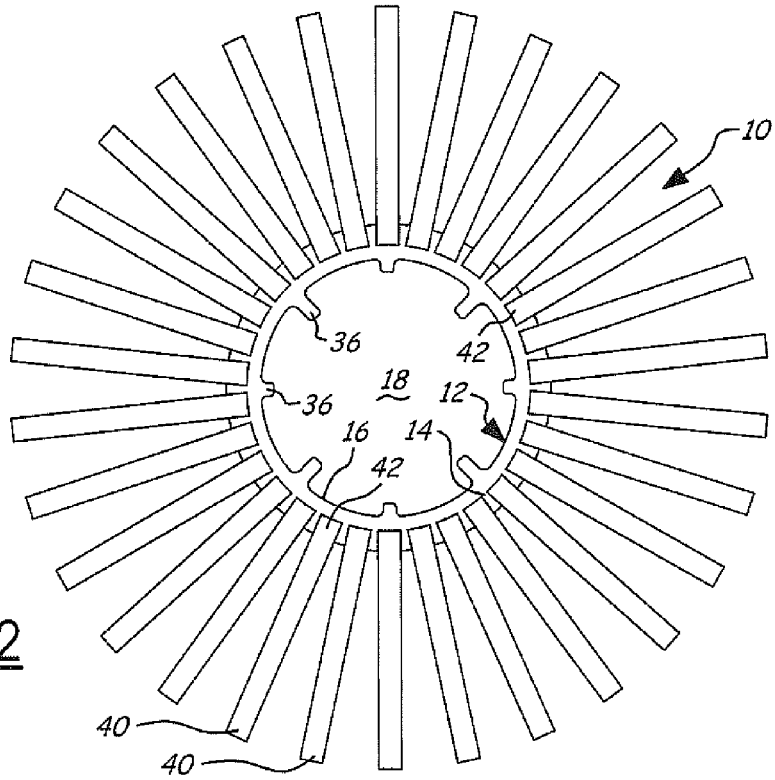
FIG. 2 is a front view of the flap wheel shown in FIG. 1.
Figure 3:
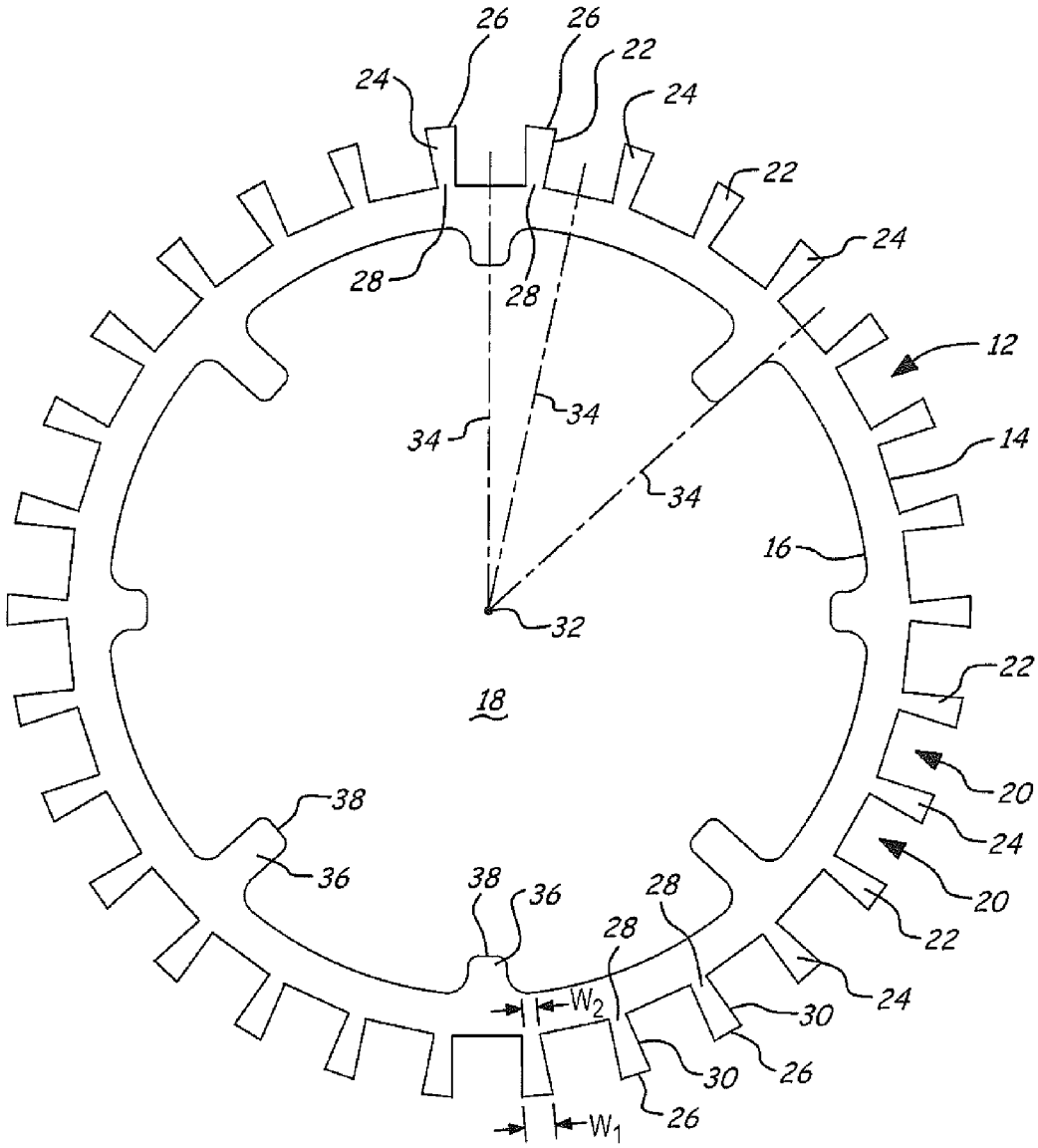
FIG. 3 is a front view of a generally cylindrical hub of the flap wheel shown in FIG. 1.

Turning now to FIGS. 1 through 3, which illustrate one embodiment of a rotary finishing device in accordance with the present invention. The rotary finishing device 10 includes a generally circular hub 12, having an outer peripheral surface or outer periphery 14, and an inner peripheral surface or inner periphery 16. The inner periphery 16 defines a passageway or throughway 18 that is preferably open to either side of the device 10. The circular hub 12 is preferably formed from a metal, such as aluminum. However, it will be understood that a variety of other materials may also be utilized, including plastic. Further, the circular hub 10 is preferably formed by an extrusion process. However, again a variety of other processes may also be utilized to form the circular hub 12. The hubs can be formed with a variety of different diameters, widths, lengths and other configurations. This flexibility is not present in current devices, i.e. the ability to provide hubs of varying lengths.

The outer periphery 14 of the device 10 includes a plurality of slots 20 formed thereabout. In this embodiment, the slots 20 are defined by a pair of side portions 22, 24 that extend generally outward from the outer periphery 14. It will be understood that the side portions 22, 24 of each of the slots 20 can extend in a variety of different directions, including inwardly. As shown best in FIG. 3, each side portion 22, 24 includes a tip portion 26, a base portion 28, and a side surface 30 extending between the base portion 28 and the tip portion 26. In this embodiment, the tip portions 26 have a greater width (w1) than the width (w2) of the base portions 28. This orientation assists in maintaining the side surfaces 30 generally parallel to one another such that each slot 20 is generally square or rectangular in shape.

Additionally, the circular hub 12 has a center point or centerline 32, which corresponds to the axis of rotation of the device 10. A reference line exists that extends from the center point 32 to a point between the pair of side portions 22, 24, as is identified by number 34. When the reference line 34 continues outwardly it passes between each of the side portions 22, 24. Here, the side surfaces 30 lie generally parallel to the reference line 34. This provides side portions 22, 24 that are oriented generally perpendicular to the outer periphery 14 of the hub 12.

Each of the slots 20 includes a finishing media 40 disposed therein. The finishing media 40 may be comprised of a single sheet of material or a plurality of sheets of material. The finishing media 40 is intended to contact a surface to be finished. The finishing media is disposed between a pair of side portions 22, 24 and its innermost portion 42 is located adjacent the outer periphery 14 of the device 10. In one embodiment, the finishing media 40 is secured within each of the slots by an adhesive, such as an epoxy. The adhesive is utilized to secure the finishing media within each slot 20 by affixing it to the outer periphery 14 of the hub 12 and the opposing side surfaces 30 of each of the side portions 22, 24. Obviously, the finishing media can be secured within each of the slots in a variety of suitable manners.

Figure 14:
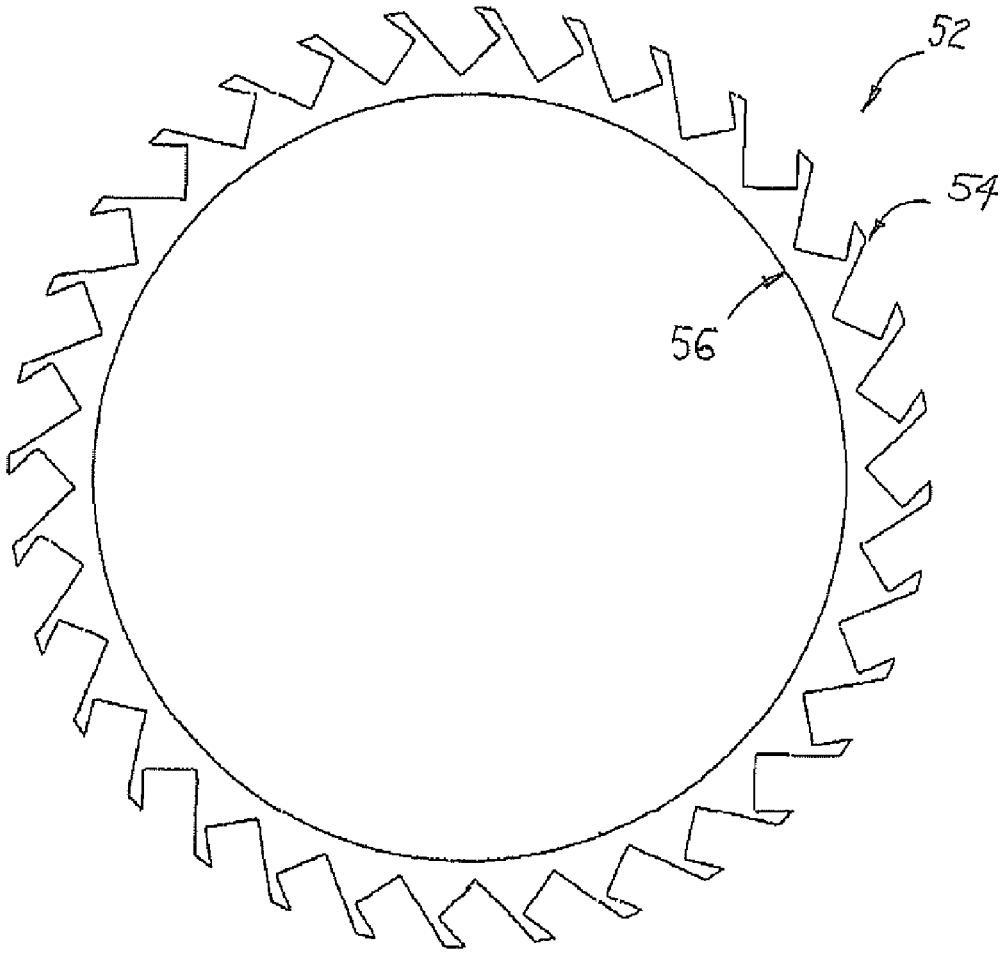
FIG. 14 is a front view of a cylindrical hub for a flap wheel in accordance with yet a further embodiment of the present invention.

The inner periphery 18 of the device 10 also includes a plurality of lugs 36 that extend generally inwardly therefrom. The lugs 36 allow for easy machining of the device 10 to true up the inside contact surface, by removing a certain portion of material from the tip 38 of at least some of the lugs 36. This provides significant material savings as well as a decrease in machining cost as only the lugs 36 require machining instead of the entire inner periphery 18 when that is used as the contact surface to drive the finishing device. The lugs 36 also allow the hub 12 to communicate with a shaft or end cap to allow easy driving thereof. It will be understood that the inner periphery 18 may alternatively be a generally smooth surface without any lugs 36. Moreover, any number of lugs may be utilized. For example, FIG. 14 illustrates a generally circular hub 52 having an outer periphery 54 and an inner periphery 56. The inner periphery 56 does not have any lugs, but instead is comprised of a smooth surface.

Figure 4:
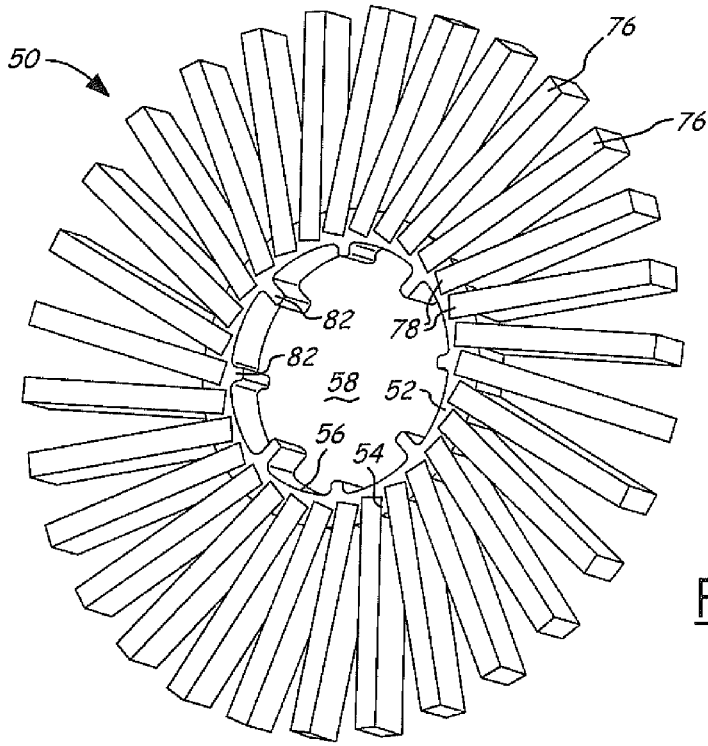
FIG. 4 is a perspective view of a flap wheel in accordance with another embodiment of the present invention.
Figure 5:
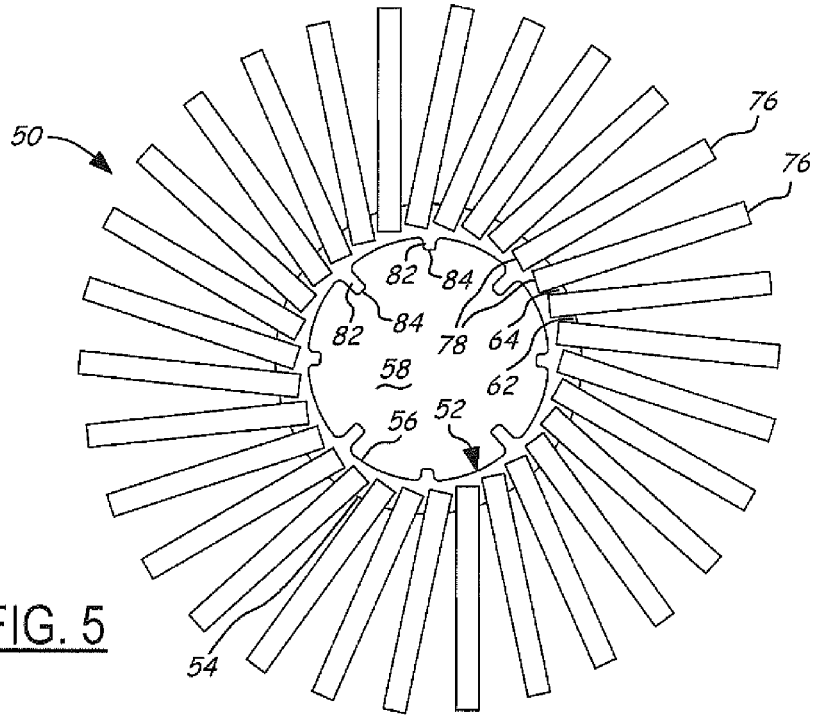
FIG. 5 is a front view of the flap wheel shown in FIG. 4.
Figure 6:
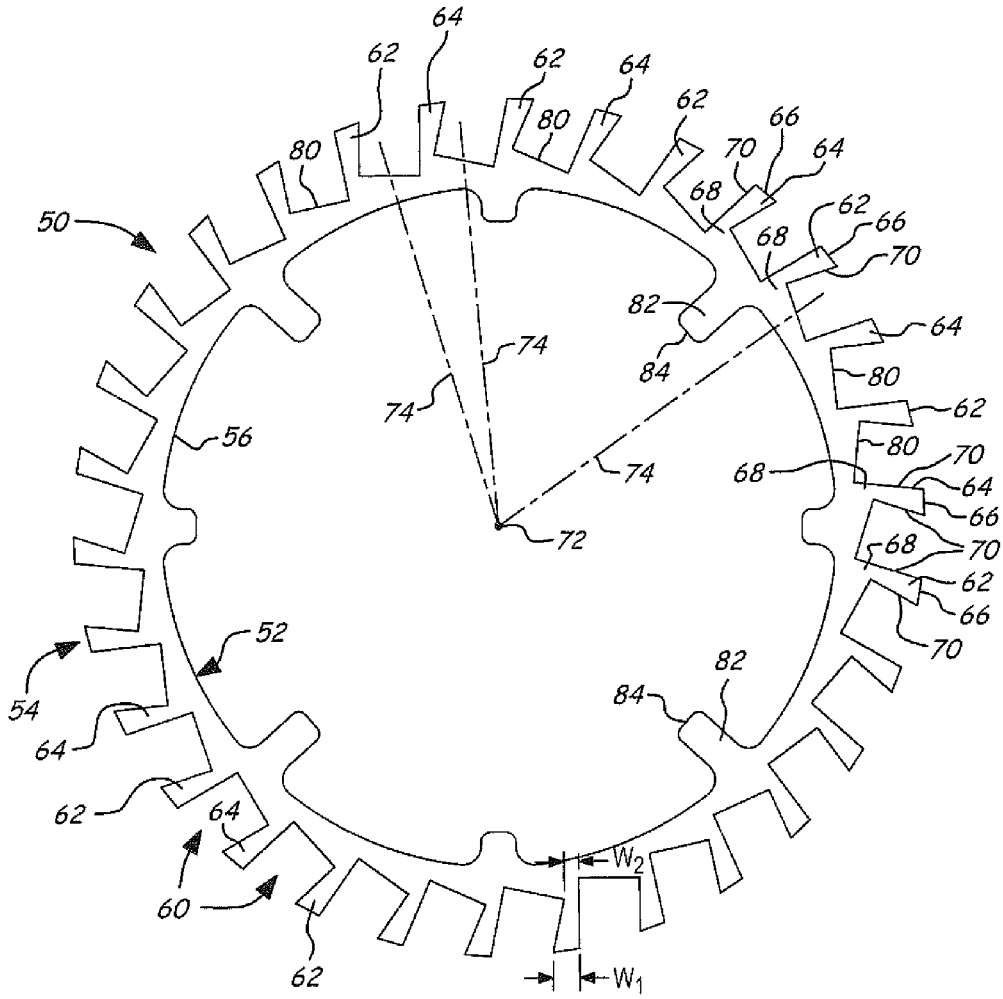
FIG. 6 is a front view of a generally cylindrical hub of the flap wheel shown in FIG. 4.
Figure 7:
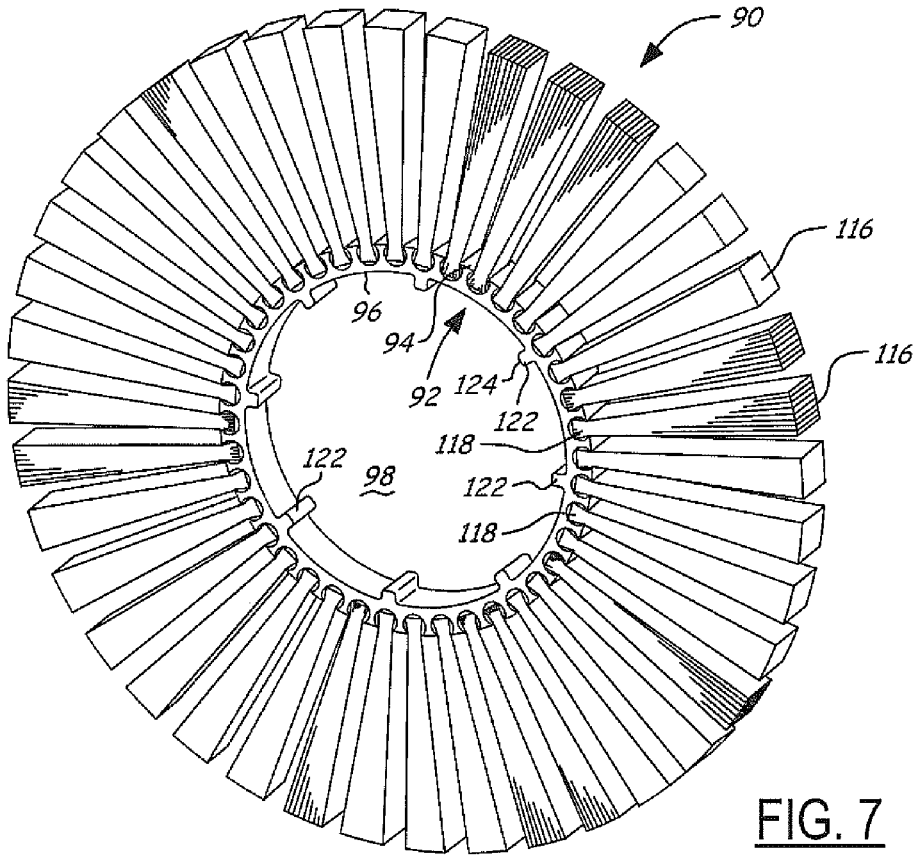
FIG. 7 is a perspective view of a flap wheel in accordance with yet another embodiment of the present invention.

FIGS. 4 through 6 illustrate another embodiment of a rotary finishing device in accordance with the present invention. The rotary finishing device 50 also includes a generally circular hub 52, having an outer peripheral surface or outer periphery 54, and an inner peripheral surface or inner periphery 56. The inner periphery 56 defines a passageway or throughhole 58 that is preferably open to either side of the device 50. Again, while the circular hub 12 is preferably formed from a metal, such as aluminum through an extrusion process, it can be formed form a variety of different materials, through different processes, and in a variety of different sizes and dimensions.

The outer periphery 54 of the device 10 includes a plurality of slots 60 formed thereabout. In this embodiment, the slots 60 are defined by a pair of side portions 62, 64 that extend generally inward from the outer periphery 54. Again, it will be understood by one of ordinary skill in the art that the side portions 62, 64 of each of the slots 60 can extend in a variety of different directions, including outwardly and can take on a variety of different configurations. As shown best in FIG. 6, each side portion 62, 64 includes a tip portion 66, a base portion 68, and a side surface 70 extending between the base portion 68 and the tip portion 66. Again, in this embodiment, the tip portions 66 have a greater width (w1) than the width (w2) of the base portions 68. This orientation assists in maintaining the side surfaces 70 generally parallel to one another such that each slot 60 is generally square or rectangular in shape.

Additionally, the circular hub 52 has a center point or centerline 72, which corresponds to the axis of rotation of the device 50. A reference line exists that extends from the center point 72 to a point between the pair of side portions 62, 64, as is identified by number 74. When the reference line 74 continues outwardly, it passes between each of the side portions 62, 64. Here, the side surfaces 70 are configured in a non-parallel orientation with respect to the reference line 74. In other words, the side portions 62, 64 are oriented at an angle with respect to the outer periphery 54.

Each of the slots 60 includes a finishing media 76 disposed therein. The finishing media 76 may be comprised of a single sheet of material or a plurality of sheets of material. The finishing media 76 is intended to contact a surface to be finished. The finishing media 76 is disposed between a pair of side portions 62, 64 and its innermost portion 78 is located adjacent the outer periphery 54 of the device 50. In one embodiment, the finishing media 76 is secured within each of the slots 60 by an adhesive, such as an epoxy. The adhesive secures the finishing media 76 within each slot 60 by affixing it to a bottom surface 80 that extends between and connects the base portions 68 of a pair of adjacent side portions 62, 64. Obviously, the finishing media 76 can be secured within each of the slots 60 in a variety of suitable manners.

The inner periphery 56 of the device 50 also includes a plurality of lugs 82 that extend generally inward therefrom. The lugs 82 allow for easy machining of the device 50 to true up the inside contact surface, by removing a certain portion of material from the tip 84 of at least some of the lugs 82. This provides significant material savings as well as a decrease in machining cost as only the lugs 82 require machining instead of the entire inner periphery 56 when that is used as the contact surface. The lugs 82 also allow the hub 52 to communicate with a shaft or end cap to allow easy driving thereof. It will be understood that the inner periphery 56 may alternatively be a generally smooth surface without any lugs. Moreover, any number of lugs may be utilized. For example, FIG. 14 illustrates a generally circular hub 52 having an outer periphery 54 and an inner periphery 56. The inner periphery 56 does not have any lugs, but instead is comprised of a smooth surface for engagement with another structure to effectuate driving of the device.

FIGS. 7 through 10 illustrate still another embodiment of a rotary finishing device in accordance with the present invention. The rotary finishing device 90 also includes a generally circular hub 92, having an outer peripheral surface or outer periphery 94, and an inner peripheral surface or inner periphery 96. The inner periphery 56 defines a passageway or throughhole 98 that is preferably open to either side of the device 90. Again, while the circular hub 92 is preferably formed from a metal, such as aluminum through an extrusion process, it can be formed form a variety of different materials, through different processes, and in a variety of different sizes.

The outer periphery 94 of the device 90 includes a plurality of slots 100 formed thereabout. In this embodiment, the slots 100 are defined by a pair of side portions 102, 104 that extend generally inward from the outer periphery 94. Again, it will be understood by one of ordinary skill in the art that the side portions 102, 104 of each of the slots 100 can extend in a variety of different directions, including outwardly and can take on a variety of different configurations. As shown best in FIG. 9, each side portion 102, 104 includes a tip portion 106, a base portion 108, and a side surface 110 extending between the base portion 108 and the tip portion 106. In this embodiment, each of the slots 100 is generally rounded in shape.

Additionally, the circular hub 92 has a center point or centerline 112, which corresponds to the axis of rotation of the device 90. A reference line exists that extends from the center point 112 to a point between the pair of side portions 102, 104, as is identified by number 114. When the reference line 114 continues outwardly, it passes between each of the side portions 102, 104. The side surfaces 100 are oriented in a non-parallel relationship to the reference line 114. However, the side portions 102, 104 lie in a parallel plane to the reference plane 114 (or generally parallel thereto) and extend from the outer periphery 94 in a generally perpendicular direction. In this embodiment, the side surfaces 100 are also not oriented generally parallel to one another.

Each of the slots 100 includes a finishing media 116 disposed therein. The finishing media 116 may be comprised of a single sheet of material or a plurality of sheets of material. The finishing media 116 is intended to contact a surface to be finished. The finishing media 116 is disposed between a pair of side portions 102, 104 and its innermost portion 118 is located adjacent the outer periphery 94 of the device 90. In one embodiment, the finishing media 116 is secured within each of the slots 100 by an adhesive, such as an epoxy. The adhesive secures the finishing media 116 within each slot 100 by affixing it within the rounded slot. Obviously, the finishing media 116 can be secured within each of the slots 100 in a variety of suitable manners.

The inner periphery 96 of the device 90 also includes a plurality of lugs 122 that extend generally inwardly therefrom. The lugs 122 allow for easy machining of the device 90 to true up the inside contact surface, by removing a certain portion of material from the tip 124 of at least some of the lugs 122. This provides significant material savings as well as a decrease in machining cost as only the lugs 122 require machining instead of the entire inner periphery 96 when that is used as the contact surface. The lugs 122 also allow the hub 92 to communicate with a shaft or end cap 126 to allow easy driving thereof. It will be understood that the inner periphery 96 may alternatively be a generally smooth surface without any lugs. Moreover, any number of lugs may be utilized.

Figure 9:
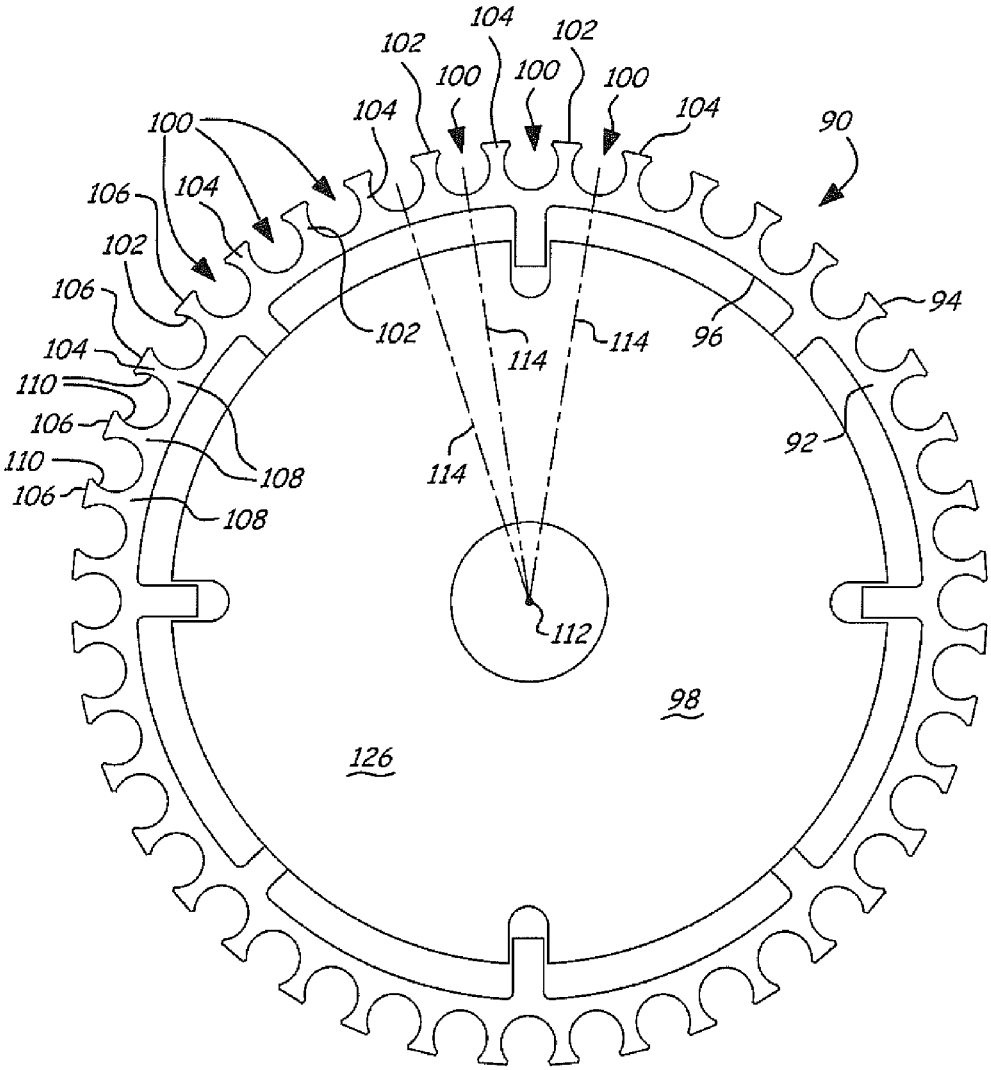
FIG. 9 is a front view of the generally cylindrical hub shown in FIG. 8 including an end cap engaging the hub.
Figure 10:
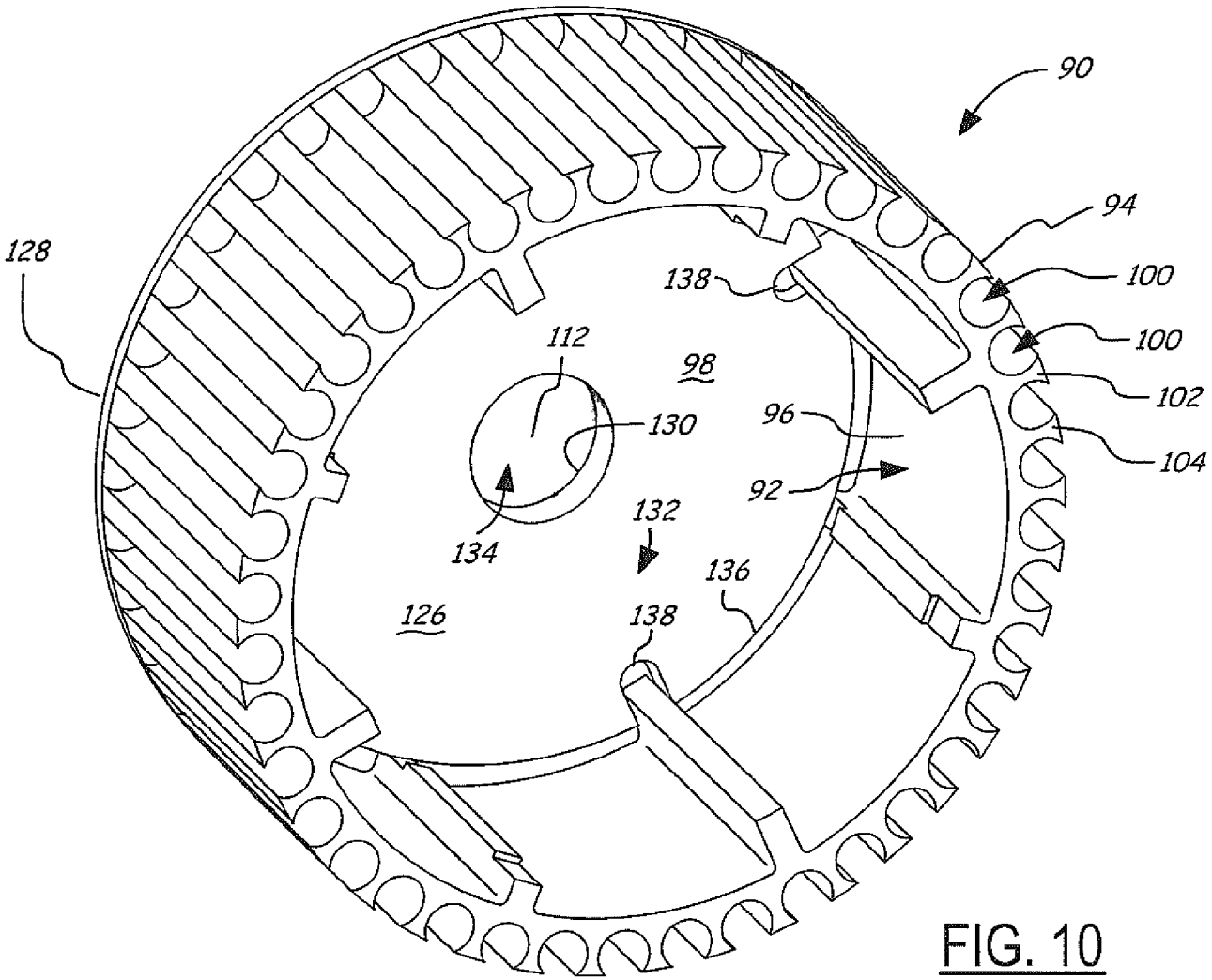
FIG. 10 is a perspective view of the generally cylindrical hub and end cap shown in FIG. 9.
Figure 11:
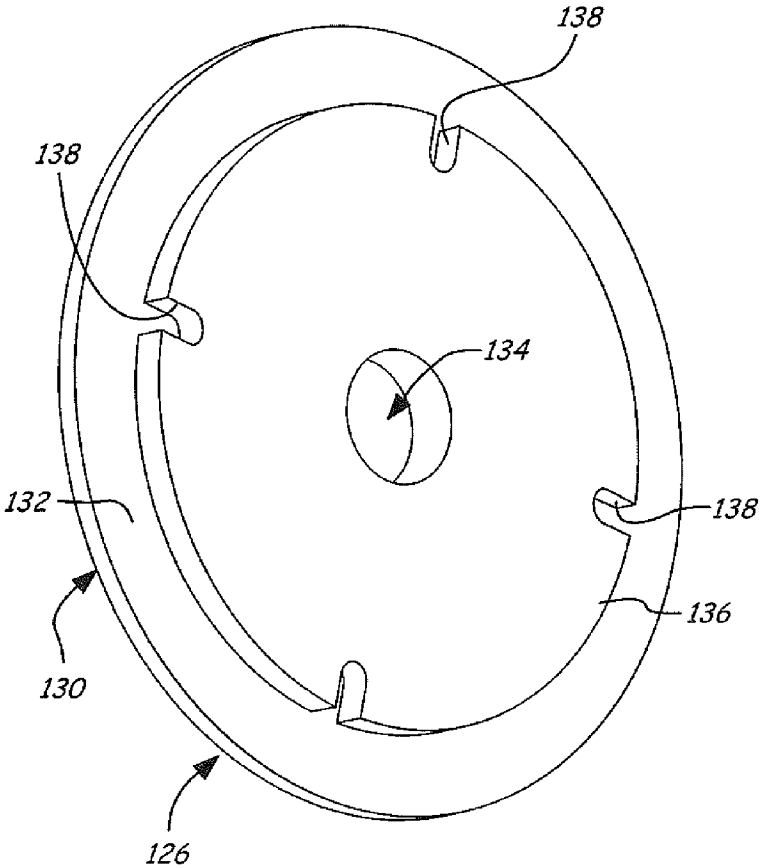
FIG. 11 is a perspective view of an end cap for attachment to a generally cylindrical hub of a flap wheel in accordance with one embodiment of the present invention.

Turning to FIGS. 9 through 11, which illustrate an end cap 126 for engagement with a rotary finishing device in accordance with the present invention. The end cap 126 is generally circular in shape and includes an outer perimeter 128, an outer side 130, an inner side 132, and an opening 134. The inner side 132 of the end cap 126 has an inner step 136 that is intended to be received in the throughhole 98 of the circular hub 92. In one embodiment, the inner step 136 includes a plurality of grooves 138 that are spaced about the periphery of the inner step 136. Each of the plurality of grooves 138 is intended to engage a respective one of the lugs 122. The end cap 126 is intended to receive a driving shaft through the opening 134. As the driving shaft rotates, it causes the end cap 126 to rotate, which is in communication with the finishing device through the lugs 122 causing it to rotate. It will be understood that the end cap 126 can take on a variety of configurations and can be configured to engage the circular hub 92 in a variety of different manners.

For example, the end cap 126 can engage the circular hub 92 on the outer periphery 94. Alternatively, the inner periphery of the circular hub may be a generally smooth surface without lugs and the end cap may have a generally smooth inner step outer periphery to effectuate engagement with the circular hub, such as is exemplarily shown in FIG. 14.

Figure 13:
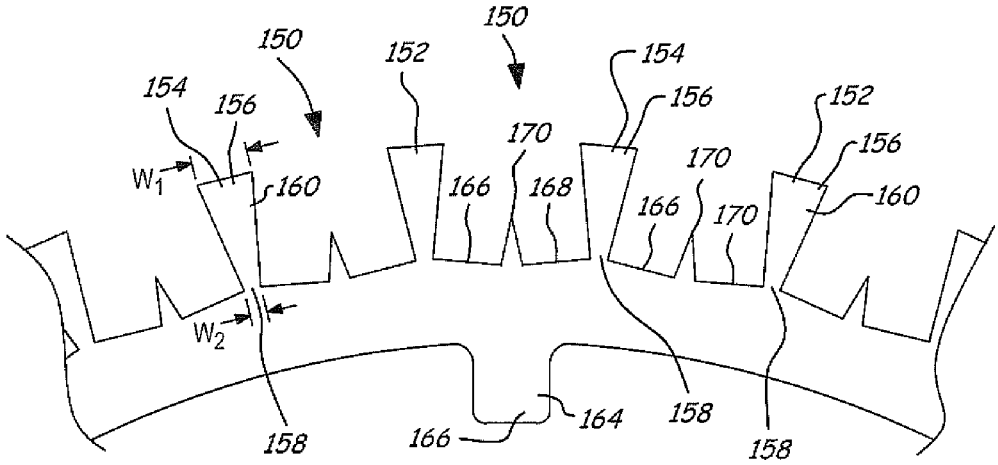
FIG. 13 is an enlarged view of a portion of the generally cylindrical hub shown in FIG. 12.
Figure 8:
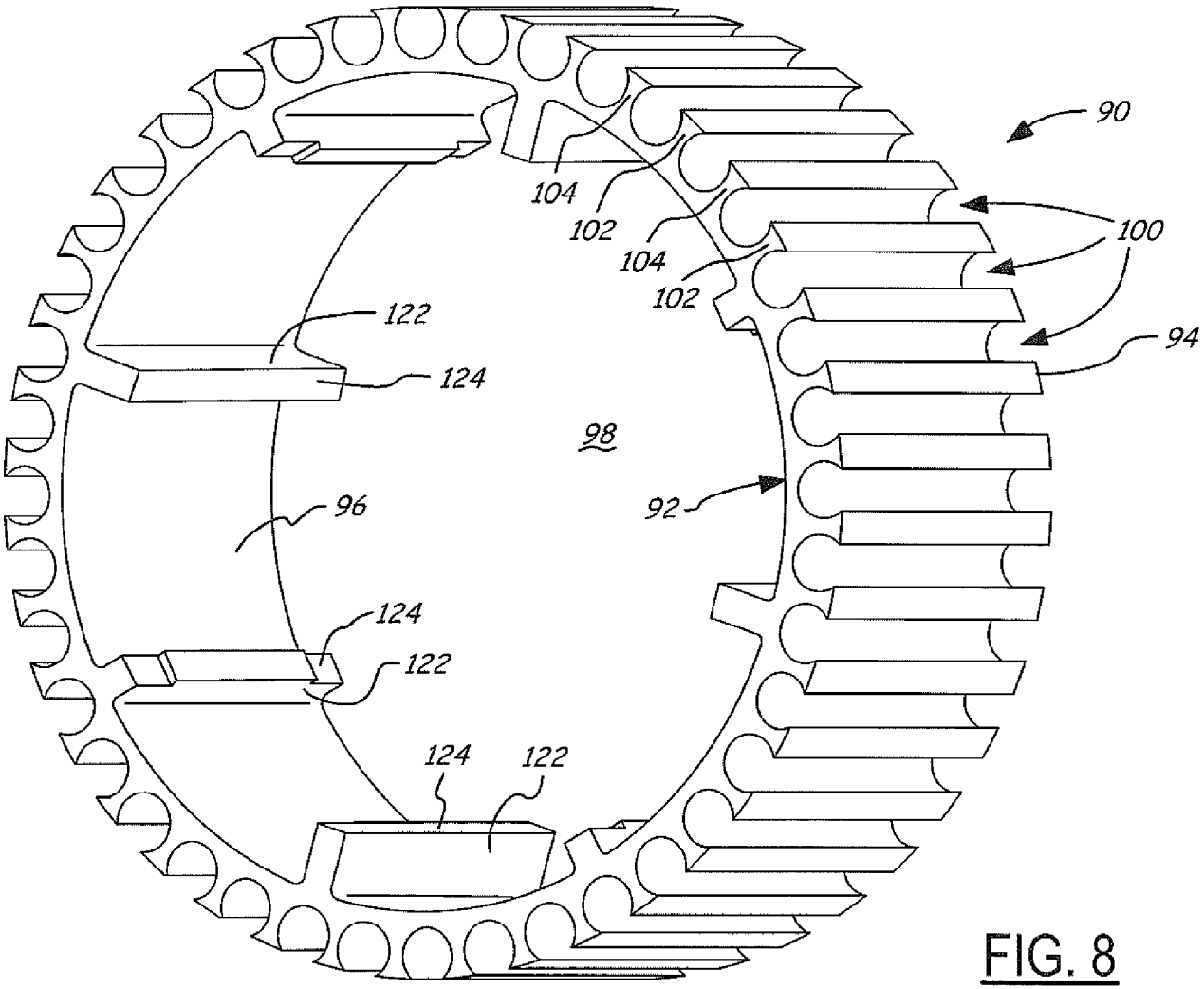
FIG. 8 is a perspective view of a generally cylindrical hub of the flap wheel shown in FIG. 7.
Figure 12:
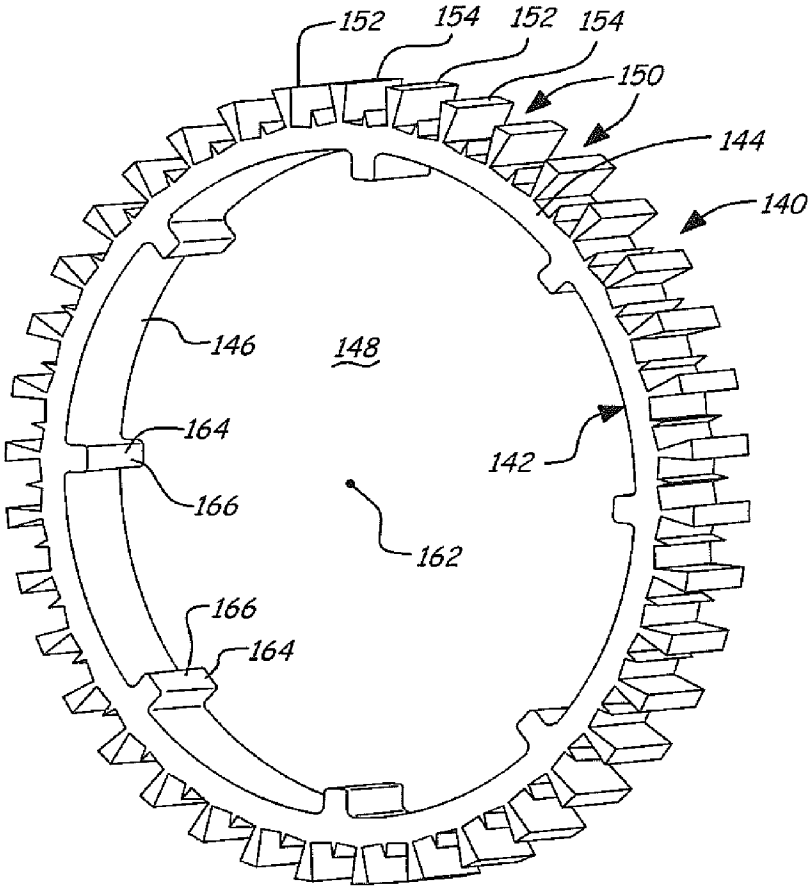
FIG. 12 is a perspective view of a generally cylindrical hub for a flap wheel, in accordance with still another embodiment of the present invention.

FIGS. 12 and 13 illustrate another embodiment of a rotary finishing device in accordance with the present invention. The rotary finishing device 140 also includes a generally circular hub 142, having an outer peripheral surface or outer periphery 144, and an inner peripheral surface or inner periphery 146. The inner periphery 146 defines a passageway or throughhole 148 that is preferably open to either side of the device 140. Again, while the circular hub 142 is preferably formed from a metal, such as aluminum through an extrusion process, it can be formed form a variety of different materials, through different processes, and in a variety of different sizes.

The outer periphery 144 of the device 140 includes a plurality of slots 150 formed thereabout. In this embodiment, the slots 150 are defined by a pair of side portions 152, 154 that extend generally outward from the outer periphery 144. Again, it will be understood by one of ordinary skill in the art that the side portions 152, 154 of each of the slots 150 can extend in a variety of different directions, including inwardly and can take on a variety of different configurations. Each of the slots 150 is intended to receive a finishing media that is secured in each slot 150 in the same manner discussed above.

As shown best in FIG. 13, each side portion 152, 154 includes a tip portion 156, a base portion 158, and a side surface 160 extending between the base portion 158 and the tip portion 156. Again, in this embodiment, the tip portions 156 have a greater width (w1) than the width (w2) of the base portions 158. This orientation assists in maintaining the side surfaces 160 generally parallel to one another such that each slot 150 is generally square or rectangular in shape. In this embodiment, the side surfaces 160 are shaped such that the distance between opposing tip portions 156 is less than the distance between opposing base portions 158. The circular hub 142 also has a center point or centerline 162, which corresponds to the axis of rotation of the device 140. A reference line exists that extends from the center point 162 to a point between the pair of side portions 152, 154. The configuration of the reference line in this embodiment corresponds to the reference line in FIG. 3. Here, the side portions 152, 154 are oriented generally parallel to the reference line and thus are oriented generally perpendicular to the outer periphery 144. This is despite the fact that the side surfaces 160 are disposed at a slight angle with respect to the reference line.

Between each of the side portions 152, 154, the outer periphery 144 consists of a pair of inwardly sloping planar surfaces 166, 168. Each of these slopes terminates at a point from which a wedge 170 extends. Accordingly, each of the slots 150 includes a wedge 170 extending outwardly from the outer periphery 144. Each wedge 170 is generally pointed and acts to spread the sheets of the finishing media apart so that they are wide at the base and cannot be easily pulled from the slot. The wedge 170 thus assists in retaining the finishing media within each of the slots 150.

Each of the slots 150 includes a finishing media (not shown) disposed therein. The finishing media may be comprised of a single sheet of material or a plurality of sheets of material. The finishing media is intended to contact a surface to be finished. The finishing media is disposed between a pair of side portions 152, 154 and its innermost portion is located adjacent the outer periphery 144 of the device 140. In one embodiment, the finishing media is secured within each of the slots 150 by an adhesive, such as an epoxy. The adhesive secures the finishing media within each slot 150 by affixing it within the rounded slot. Obviously, the finishing media can be secured within each of the slots in a variety of suitable manners.

The inner periphery 146 of the device 140 also includes a plurality of lugs 164 that extend generally inwardly therefrom. The lugs 164 allow for easy machining of the device 140 to true up the inside contact surface, by removing a certain portion of material from the tip 166 of at least some of the lugs 164. This provides significant material savings as well as a decrease in machining cost as only the lugs 164 require machining instead of the entire inner periphery 146 when that is used as the contact surface. The lugs 164 also allow the hub 142 to communicate with a shaft or end cap to allow easy driving thereof. It will be understood that the inner periphery may alternatively be a generally smooth surface without any lugs. Moreover, any number of lugs may be utilized.

While particular embodiments of the invention have been shown and described, numerous variations and alternate embodiments will occur to those skilled in the art. Accordingly, it is intended that the invention be limited only in terms of the appended claims.

What is claimed is:

1. A rotary finishing device, comprising:

a generally circular hub having an inner periphery and an outer periphery, said inner periphery defining a throughhole:

a plurality of slots formed about said outer periphery of said generally circular hub, each of said plurality of slots being defined by a pair of side portions extending from said outer periphery, said plurality of slots being generally uniformly spaced around said generally circular hub; and at least one of said plurality of slots having at least one finishing sheet secured therein by an adhesive;

at least one serration formed in each of said plurality of slots to assist in adhering said at least one finishing sheet to said hub.

2. The rotary finishing device of claim 1, wherein said generally cylindrical hub is formed of a metal material.

3. The rotary finishing device of claim 2, wherein said generally cylindrical hub is constructed of aluminum.

4. The rotary finishing device of claim 1, wherein said generally cylindrical hub is formed by an extrusion process.

5. The rotary finishing device of claim 1, wherein said pair of side portions extends generally outward from said outer periphery.

6. The rotary finishing device of claim 1, wherein said pair of side portions extends generally inward from said outer periphery.

7. The rotary finishing device of claim 1, wherein said generally circular hub includes a centerline defining a reference axis that extends from said centerline to a point between said side portions and wherein said pair of side portions extend from said outer periphery in a direction generally parallel to said reference axis.

8. The rotary finishing device of claim 1, wherein said generally circular hub includes a centerline defining a reference axis that extends from said centerline to a point between said side portions and wherein said pair of side portions extend from said outer periphery in a direction parallel to said reference axis.

9. The rotary finishing device of claim 1 wherein said pair of side portions extends from said outer periphery such that each of said plurality of slots is generally rounded.

10. The rotary finishing device of claim 1, wherein said adhesive secures said at least one finishing sheet within said slot by adhering it to each of said pair of side portions.

11. The rotary finishing device of claim 1, further comprising;

an end cap in communication with said generally cylindrical hub such that a portion of said end cap is in communication with said generally cylindrical hub to effectuate driving thereof.

12. The rotary finishing device of claim 1, wherein each of said plurality of slots includes at least one finishing sheet secured therein by an adhesive.

13. The rotary finishing device of claim 12, wherein each of said plurality of slots includes at least one sheet of sandpaper secured therein by an adhesive.

* * * * *